US006931774B2

(12) United States Patent
Howell, Jr.

(10) Patent No.: US 6,931,774 B2
(45) Date of Patent: Aug. 23, 2005

(54) SMOKELESS CYLINDER FOR MUZZLE-LOADING REVOLVER

(76) Inventor: Kenneth P. Howell, Jr., 5728 E. County Rd. X, Beloit, WI (US) 53511

( * ) Notice: Subject to any disclaimer, the term of this patent is extended or adjusted under 35 U.S.C. 154(b) by 60 days.

(21) Appl. No.: 10/624,773

(22) Filed: Jul. 22, 2003

(65) Prior Publication Data

US 2005/0016050 A1 Jan. 27, 2005

(51) Int. Cl.[7] ..... F41C 9/08

(52) U.S. Cl. ..... 42/61; 42/51; 42/65; 89/27.13; 89/27.14

(58) Field of Search ..... 42/51, 59, 61, 42/65, 50, 67, 77, 89.13; 89/27.13, 27.14

(56) References Cited

U.S. PATENT DOCUMENTS

| | | | | | |
|---|---|---|---|---|---|
| 2,830,398 | A | * | 4/1958 | Donohue | 42/68 |
| 3,757,448 | A | * | 9/1973 | Petrucci | 42/59 |
| 3,765,116 | A | * | 10/1973 | Zaid | 42/89 |
| 3,872,615 | A | * | 3/1975 | Grandy | 42/49.01 |
| 4,197,666 | A | * | 4/1980 | Ng | 42/59 |
| 4,221,065 | A | * | 9/1980 | Curran | 42/65 |
| 4,227,330 | A | * | 10/1980 | Chapin | 42/77 |
| 4,253,261 | A | * | 3/1981 | Schmidt | 42/59 |
| 4,455,777 | A | * | 6/1984 | Callies | 42/59 |
| 4,457,093 | A | * | 7/1984 | Olsen | 42/59 |
| 4,593,602 | A | * | 6/1986 | Faix | 89/1.813 |
| 4,735,009 | A | * | 4/1988 | Jett, Jr. | 42/77 |
| 4,827,650 | A | * | 5/1989 | Ladriere | 42/76.01 |
| 4,888,901 | A | * | 12/1989 | French et al. | 42/51 |
| 5,115,716 | A | * | 5/1992 | Doering et al. | 89/25 |
| 5,305,678 | A | * | 4/1994 | Talbot et al. | 89/14.3 |
| 5,443,542 | A | * | 8/1995 | Khoury | 42/59 |
| 6,029,385 | A | * | 2/2000 | Howell, Jr. | 42/59 |
| 6,047,490 | A | * | 4/2000 | Kirst | 42/59 |
| 6,314,670 | B1 | * | 11/2001 | Rodney, Jr. | 42/51 |
| 6,634,128 | B1 | * | 10/2003 | Vastag | 42/59 |
| 6,688,232 | B2 | * | 2/2004 | Griesbach et al. | 102/288 |
| 2002/0035800 | A1 | * | 3/2002 | Lewis | 42/51 |

FOREIGN PATENT DOCUMENTS

| | | | |
|---|---|---|---|
| DE | 2329281 | * | 1/1975 |
| DE | 2723983 | * | 12/1978 |
| GB | 2329456 | * | 3/1999 |

* cited by examiner

*Primary Examiner*—Michael J. Carone
*Assistant Examiner*—John Richardson
(74) *Attorney, Agent, or Firm*—Leydig, Voit & Mayer, Ltd.

(57) ABSTRACT

A replacement cylinder that enables the use of modern smokeless gunpowder in a black powder muzzle-loading revolver is provided. The cylinder includes a main cylinder body and a removable cylinder cap. The main cylinder body includes a number of chambers, each of which having a projectile portion, a propellant portion and a primer portion. The cylinder cap includes a number of captured firing pins positioned therein. During operation, the cylinder cap is allowed to axially translate relative to the main cylinder body. A method of muzzle-loading the cylinder of the invention using modern smokeless gunpowder and a primer is also provided and is facilitated by the provision of a loading plate.

19 Claims, 3 Drawing Sheets

SMOKELESS CYLINDER FOR MUZZLE-LOADING REVOLVER

FIELD OF THE INVENTION

The present invention relates generally to muzzle-loading revolvers, and more particularly to a cylinder for use in historic or replica muzzle-loading revolvers.

BACKGROUND OF THE INVENTION

The popularity of shooting sports continues to increase both in the United States and abroad. In addition to the numerous Olympic shooting events, thousands of amateur and professional sanctioned shooting events are held across various countries around the world each year. Indeed, numerous such events sanctioned by various clubs and organizations hold international competitions and championship matches.

One such shooting sport that traces its beginnings to 1979, and that has experienced explosive growth worldwide over the last several years, is known as Cowboy Action Shooting™. This shooting sport, and various variants thereof, are regulated by the Single Action Shooting Society (SASS) and other like organizations and shooting clubs across the globe. In this sport, the participants are required to demonstrate their shooting skills with guns that date from circa 1860 to the turn of the century, or modern day replicas of such guns. This particular shooting sport brings back a sense of the American frontier of the mid to late 1800s. Indeed, in SASS sanctioned events the participants are required to dress in period costumes and utilize period sounding names. Such sanctioned events also include separate classes for percussion (cap and ball), black powder cartridge, and smokeless cartridge guns. Further, traditional and modern classes are included to differentiate firearms that utilize, for example, fixed versus adjustable sights.

While initially Cowboy Action Shooting™ was primarily a sport engaged in the United States, the shooting of historic and replica firearms is catching on at an accelerating rate worldwide. While the reasons for this worldwide increase in the popularity of shooting such historic revolvers may be largely a factor of the nostalgia and romance of the period from which these firearms are based, i.e. the mid-1800 American frontier, other reasons may be much more practical.

For example, one country that has embraced the shooting of historic revolvers is Great Britain. While the British have had a long history of Police Pistol matches and club shooting, a fairly recent act of Parliament, the Firearms (Amendment) Act of 1997, expanded the long-standing prohibition of certain handguns. Since the enactment of the Firearms Act of 1997, the only legal firearms that have a barrel less than 30 centimeters in length or that are less than 60 centimeters in length overall are air weapons, small caliber pistols, muzzle-loading guns, or a firearm designed as a signaling apparatus. Under this Act, a small caliber pistol is defined as a pistol chambered for .22 or smaller rim-fire cartridges. However, such small caliber pistols are not particularly useful in many of the shooting competitions, nor are air pistols. However, this Act does allow muzzle-loading guns, which are defined as a gun designed to be loaded at the muzzle end of the barrel or chamber with a loose charge and a separate ball (or other missile). Such guns have long been used in shooting competitions.

As a direct result of the Firearms (Amendment) Act of 1997, the number of individuals and private clubs that sponsor Historic Revolver black powder shooting competitions has increased dramatically. Indeed, in Great Britain Historic Revolver is a fast-growing black powder discipline that closely assimilates the now defunct Police Pistol matches which were so popular before the loss of cartridge pistols with the 1997 Firearms Act. Currently, an extensive program of Historic Revolver leagues are run in Great Britain that are suitable for "spirit of the original" and free percussion revolvers (such as Ruger Old Army revolvers).

However, as more people become involved in shooting black powder muzzle-loading cap and ball revolvers, more people understand why cartridge ammunition and smokeless powder easily replaced this technology. That is, the use of black powder in such firearms presents a number of challenges and problems that must be specifically addressed at all times to prevent or minimize the dangers posed to the participants as well as damage to the revolvers themselves.

First, it should be understood that black powder is an explosive, and therefore presents significant risk to those around it. This is contrasted with modern-day smokeless gunpowder which is defined as a propellant and not specifically an explosive. Indeed, a number of the rules regulating black powder muzzle-loading shooting events concentrate on black powder safety in restricting smoking, the amount, and storage requirements for the black powder for such firearms. Further, the dangers posed by black powder do not end when placed in the muzzle-loading cylinder of a revolver. Specifically, if the ball is not packed tightly enough onto the powder within the cylinder of the muzzle-loading revolver, the explosion of the black powder may actually cause damage to the cylinder, including "blowing up" of the gun itself.

Additionally, the fire produced by the black powder when one chamber is fired may result in a chain fire of other chambers not aligned with the barrel. This "chain fire" results from the ignition of black powder within other chambers resulting from the flashback from the fired chamber into these other chambers. To prevent this problem, many shooters apply grease to the mouth of each chamber over the top of the ball. This grease will help to extinguish or not pass the fire from the chamber being fired, and serves the supplemental purpose of aiding in the cleaning of the gun and lubrication of the barrel, bore, and cylinder pin, allowing many more shots to be fired accurately. Alternatively, some shooters use a greased wad between the black powder and ball, such as an Ox Yoke Wonder Wad for this same purpose.

Another problem with which the participants in such Historic Revolver shooting sports must contend is the smoke produced when the black powder muzzle-loading revolver is fired. Specifically, the smoke and residue of the black powder is corrosive, and will pit the firearm if it is not cleaned thoroughly after each competition. This extensive cleaning requirement presents a problem for many original and replica black powder muzzle-loading firearms as they are not easily disassembled for such purpose. Further, the sheer amount of smoke that is generated each time a black powder revolver is fired also presents a problem to many participants and shooting facilities. That is, participants who suffer from asthma or other respiratory problems may find the amount of smoke produced during such shooting competitions to be problematic. Similarly, many indoor shooting clubs do not allow the use of black powder for indoor competitions as their ventilation system is unable to appropriately deal with the amount and corrosive nature of the smoke produced during such shooting competitions.

While modern smokeless powder overcomes many of these problems associated with black powder, such high pressure nitrocellulose propellant is available only in or for cartridge ammunition, which is specifically prohibited in Great Britain. Further, such modern-day smokeless powder is unsuitable for historic and replica muzzle-loading revolvers that utilize percussion caps on nipples to ignite the black powder. As such, there exists a need in the art for a replacement cylinder for historic and replica muzzle-loading revolvers that allows the use of modern day smokeless powder.

BRIEF SUMMARY OF THE INVENTION

In view of the above, it is an object of the present invention to provide a new and improved cylinder for a muzzle-loading revolver. More particularly, it is an object of the present invention to provide a new and improved cylinder for a historic or replica revolver that allows the use of modern smokeless gunpowder as the projectile propellant.

In accordance with one aspect of the present invention, the new and improved cylinder is of two-piece construction having a main cylinder body and a cylinder cap removably positioned over the breech side of the cylinder body. Preferably, the cylinder/cylinder cap assembly conforms to the external dimensions of the original cylinder of the historic or replica revolver originally designed and provided with the muzzle-loading firearm. The main cylinder body includes a number of chambers into which a primer, a measure of smokeless gunpowder, and a projectile may be loaded. Specifically, each chamber includes a first diameter portion into which the projectile will be loaded, and a smaller diameter second portion which will contain the smokeless gun powder. The transition between these two portions of the cylinder is preferably sloped so that gunpowder will be funneled into the smaller diameter portion and will not excessively accumulate on the transition between the two cylinder portions. The breech side of the cylinder body includes a larger diameter recessed portion adapted to accommodate a typical shotgun shell primer that will be used to ignite the smokeless gunpowder during firing. The main cylinder body preferably also includes a center pin bore therethrough to allow proper mounting and rotation within the firearm.

The cylinder cap includes a male body portion that is slidably accommodated within the center pin bore of the main cylinder body. In a preferred embodiment, the cylinder cap also includes a locating hole that can accommodate a cap alignment pin of the main cylinder body to insure proper alignment of the captured firing pins included in the cylinder cap. These captured firing pins are preferably installed in the cylinder cap through the use of a fairel. The cylinder cap also includes a number of ratchet recesses to allow for proper indexing of the cylinder when installed in the muzzle-loading firearm. In a preferred embodiment, the cylinder cap is allowed to axially translate during firing of a chamber a small amount to prevent excessive pressure buildup within the cylinder. This axial translation is limited when the cylinder cap meets the percussion plate of the firearm. In one embodiment, this lateral translation ranges between .002–.003, and may be up to .006 of an inch depending on the revolver.

To load the cylinder of the present invention, the cylinder and cap are removed from the firearm. The cylinder cap is then removed from the breech end of the cylinder body and a loading plate is placed thereon. The proper measure of smokeless gunpowder is then placed in one of the chambers of the main cylinder body. The projectile, preferably a modern rifled slug, is then pressed into the chamber until it is fully seated therein. Preferably this occurs when the back end portion of the projectile contacts the shoulder portion between the first and second diameter portion of the chamber. Once this has been accomplished for each of the chambers, the main cylinder body is turned over and the loading plate is removed from the breech end thereof. At this point, a modern shotgun primer is then placed at the breech end of each of the chambers of the cylinder. The cylinder cap is then replaced on the main cylinder body and the assembly reinstalled in the revolver.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
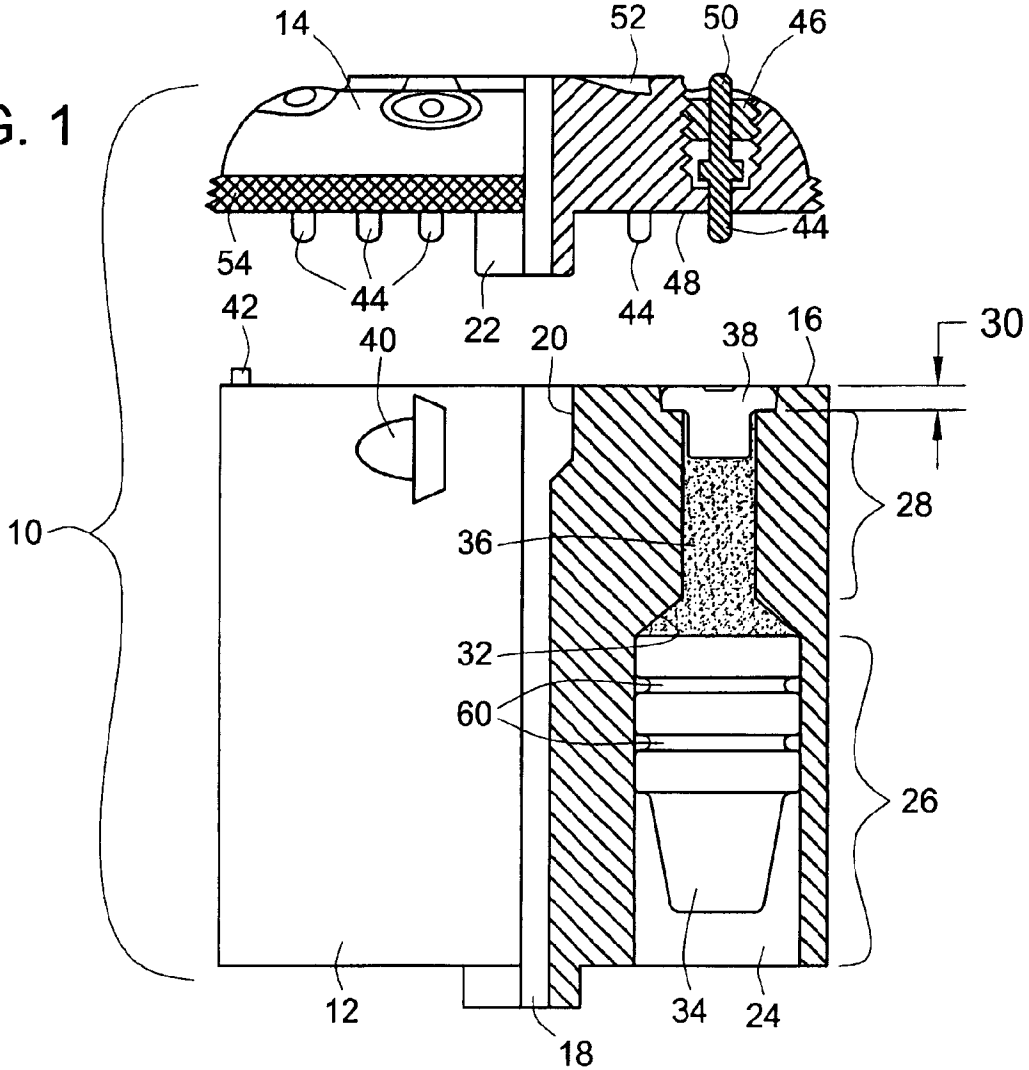
FIG. 1 is an exploded partial cross-sectional illustration of a cylinder assembly for a muzzle-loading revolver that is adapted to utilize modern smokeless gunpowder for a muzzle-loading revolver.

Turning now to the drawings, there is illustrated in FIG. 1 a partial cutaway and exploded view of an embodiment of a smokeless cylinder assembly 10 for a muzzle-loading revolver constructed in accordance with the teachings of the present invention. As may be seen from this exemplary embodiment, the cylinder 10 includes a main cylinder body 12 and a cylinder cap 14 that is slidably positioned on the breech end 16 of the main cylinder body 12. The exterior dimensions of the cylinder 10 are modified for each muzzle-loading revolver for which it will be used to replace the current black powder cylinder to maintain fit, form and function as well as overall appearance of the revolver.

The main cylinder body 12 includes a center pin hole or bore 18 through the center thereof for interfacing with the cylinder center pin of the revolver into which it is to be installed. This center pin hole 18 transitions from a first diameter portion that is sized to accommodate the center pin of the revolver to a second, larger diameter portion 20 at the breech end 16 of the main cylinder body 12 to accommodate the insertion of the cylinder cap stub 22 therein. In a preferred embodiment, this second diameter portion 20 of the center pinhole 18 has a smooth bore to allow for slidable engagement with the cylinder cap stub 22, the function of which will be described more fully below.

The main cylinder body 12 also includes a number of chambers 24 positioned radially around the interior periphery of the main cylinder body 12, the location and spacing of which is dictated by the operation and original design of the revolver. In a preferred embodiment, six chambers are included in the main cylinder body 12. Each chamber 24 includes a projectile portion 26, a propellant portion 28, and a primer portion 30. Between the projectile portion 26 of chamber 24 and the propellant portion 28, each chamber 24 preferably includes a shoulder 32. In a preferred embodiment, this shoulder 32 serves primarily two functions. First, it prevents the projectile 34 from being pushed too far into the cylinder 24. Second, in embodiments where the shoulder 32 forms a conical wall as opposed to a stepped shoulder, it serves to funnel the propellant 36 into the propellant portion 28 of cylinder 24, minimizing or altogether preventing the buildup of propellant 36 at the transition between the projectile portion 26 and the propellant portion 28 of the chamber 24. The primer portion 30 of chamber 24 is of a larger diameter than the propellant portion 28 to accommodate the rim of a modern primer 38 so that the top of the primer will be approximately flush with the breech end 16 of the main cylinder body 12. As may be seen from the illustration of FIG. 1, the primer 38 extends somewhat into the propellant portion 36 of the chamber 24.

While the overall dimensions of the cylinder 10 are dictated by the operational dimensions of the revolver into which it is to be installed, the interior dimensions of the chamber 24 may be varied to allow various caliber projectiles to be used, and to provide specific muzzle velocity and other shooting characteristics. That is, the diameter of the propellant portion 28 of chamber 24 is sized to hold a proper amount of modern smokeless gunpowder to allow the revolver to be used in shooting competitions as described above. For example, the Single Action Shooting Society Shooter's Handbook, $10^{th}$ Edition (Version 10.2), April 2003, specifies that the revolver ammunition must have a muzzle velocity less than 1,000 feet per second. In an embodiment of the present invention wherein the projectile portion 26 of chamber 24 is sized to hold a .45 caliber Colt slug of between 180 to 255 grains, and preferably 200 grains, the propellant portion 28 of chamber 24 is sized to hold approximately 4½ grains of tight group powder, although it may sized to hold between 3 to 3½ grains, or as much as 5 grains of unique powder.

The exterior surface of the main cylinder body 12 may include cosmetic or functional elements to conform the cylinder 10 to the overall look and operation of the original black powder cylinder which it will replace. For example, a typical cylinder will include a number of stops 40 around the outer periphery thereof. In a preferred embodiment, the main cylinder body 12 also includes a locating pin 42 that is accommodated in the cylinder cap 14 to allow proper alignment of the cylinder cap 14 with the main cylinder body 12 as will be discussed more fully below. Obviously, the pin may be located on the cylinder cap 14 instead of the cylinder body 12.

The cylinder cap 14 is positioned on the breech end 16 of the main cylinder body 12 via a slidable engagement of the cylinder cap 22 within portion 20 of the center pin hole 18 of the main cylinder body 12. Proper positioning of the firing pins 44 is ensured through the provision of the locating pin 42. That is, a male and female portion on the main cylinder body and the cylinder cap ensures that the rotational alignment of the cylinder cap 14 results in an alignment of the firing pins 44 with the primers 38 when installed in each of the chambers 24 of the main cylinder body 12. These firing pins 44 are moveably captured within fairels 46 that are fixably installed in the cylinder cap 14. Once the cylinder cap 14 is installed on the breech end 16 of the main cylinder body 12, the firing pins 44 are laterally translated by contact with the primers 38 so that the inner surface 48 of cylinder cap 14 may come into contact with the breech end 16 of the main cylinder body 12. Once installed in the revolver, the striking of the hammer on the breech end 50 of the firing pin 44 will ignite the primer 38 to shoot the projectile 34.

The cylinder cap 14 also includes a plurality of ratchets 52 which allow the action of the revolver to rotate the cylinder 10 as the trigger is pulled to bring a chamber 24 in alignment with the hammer and barrel in preparation for firing. In one embodiment of the present invention, the cylinder cap 14 may also include an area of knurling 54 to aid in the rotation of the cylinder cap 14 during installation thereof, and of the overall cylinder assembly 10 once installed in the muzzle-loading revolver.

The slidable assembly of the cylinder cap 14 in the cylinder body 12 via the stub 22 in larger diameter portion 20 of the center pin hole 18 provides an operational advantage during firing of the revolver. Specifically, the slidable engagement allows the cylinder cap to be axially translated by the ignition of the smokeless gunpowder 36 to provide some pressure relief during firing of the chamber 24. The amount of axial translation on the central axis is limited by the location of the percussion plate of the revolver. This axial translation is preferably within the range of .002–.003", and may be as large as approximately .006" depending on the particular revolver into which the cylinder 10 has been installed.

Figure 2:
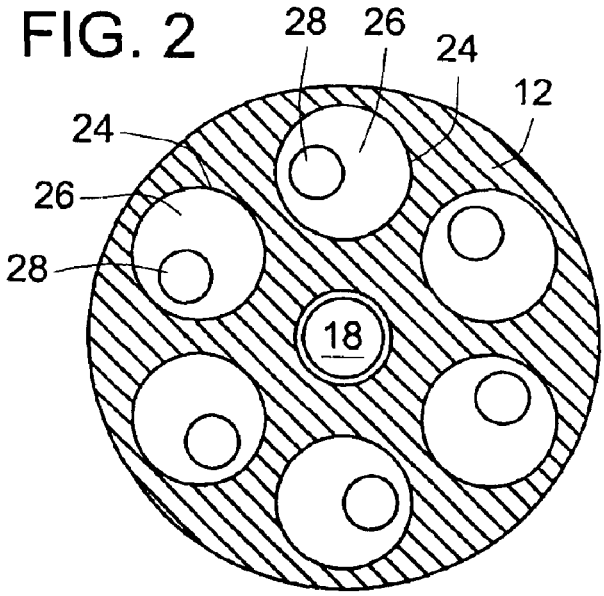
FIG. 2 is a muzzle end view of one embodiment of a cylinder body specifically adapted to a particular model muzzle-loading replica revolver in accordance with the teachings of the present invention.
Figure 3:
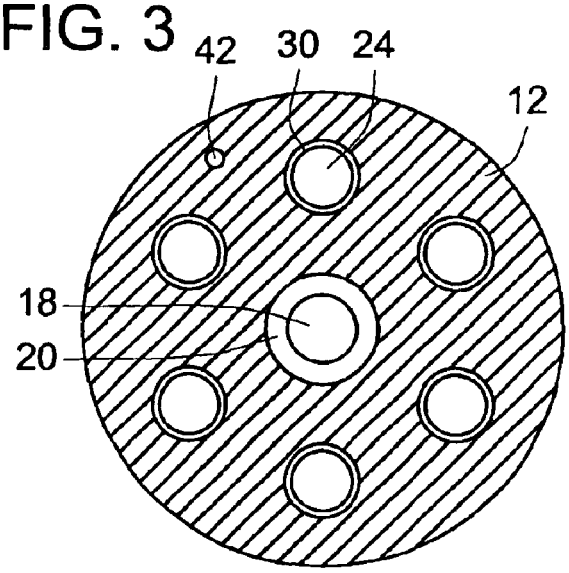
FIG. 3 is a breech end view of the cylinder body of FIG. 2.
Figure 4:
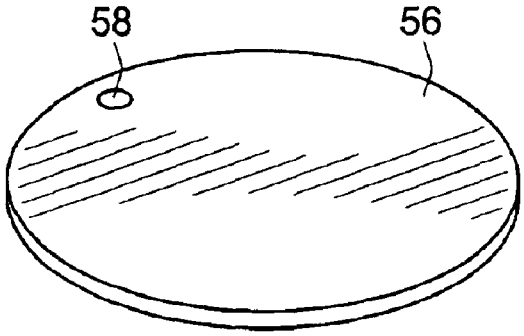
FIG. 4 is a isometric illustration of a loading plate of the present invention.
Figure 5:
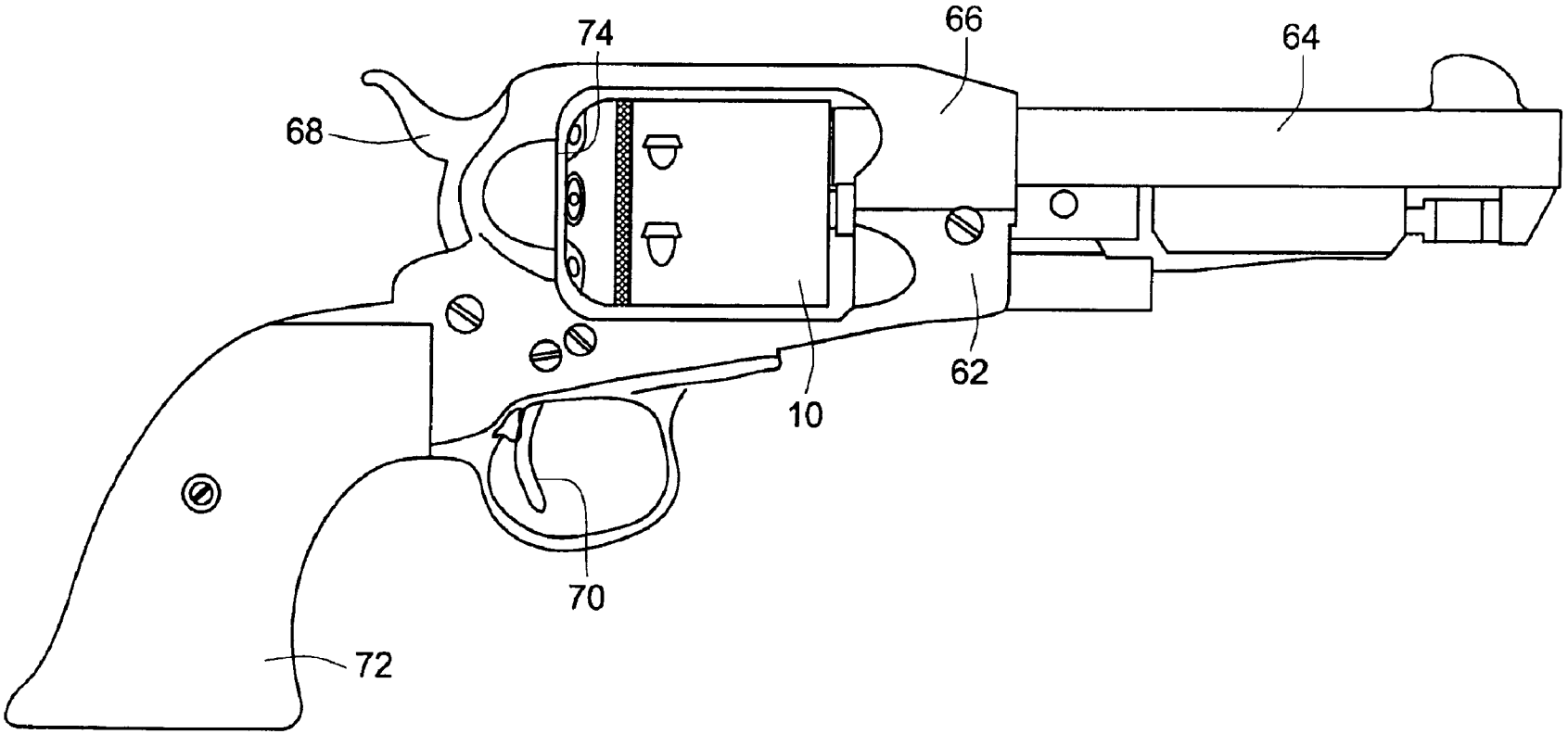
FIG. 5 is a perspective view of a muzzle-loading revolver utilizing the smokeless cylinder of the present invention.

While the embodiment of FIG. 1 illustrates an axial alignment between the projectile portion 26, the propellant portion 28, and the primer portion 30 of chamber 24, some models of historic revolvers require an offset in the positioning of the primer location. This offset is dictated by the original design of various models of muzzle-loading black powder revolvers due to the use of percussion caps and nipples. That is, in certain models, for example the 1858 Remington Pietta, the 1858 Remington Uberti, the 1873 Colt Uberti Cattleman, and the Ruger Old Army revolvers, the area at which the hammer would strike the percussion cap is offset somewhat from the alignment of the projectile portion of the chamber and the barrel of the revolver. To accommodate such models, the chambers 24 in the main cylinder body 12 are modified to provide the appropriate location for both the projectile portion and the primer as illustrated in the end view of FIG. 2. Specifically, FIG. 2 provides a muzzle end view of the main cylinder body 12 illustrating the offsets required for the primer location relative to the projectile portion 26 of the chambers 24. However, as may be seen in the breech end view of FIG. 3, the offset location of the primer portion 30 of chambers 24 is not noticeable. Preferably, the propellant portion 28 is aligned with the primer position 30 of chamber 24.

To facilitate the muzzle-loading of the main cylinder body 12, a loading plate 56 having a locating pin hole 58 may be used. Specifically, the cylinder assembly 10 is removed from the revolver and the end cap 14 removed from the main cylinder body 12. The loading plate 56 is then positioned on the breech end 16 of the main cylinder body 12, with the locating pin 42 seated in the locating pin hole 58 on the plate 56. A proper measure of powder may then be added to the cylinder 24 without concern for the smokeless gunpowder falling out of the breech end of the chamber 24. The projectile may then be positioned in the chamber 24 until it encounters the shoulder 32 between the projectile portion 26 and the propellant portion 28 of chamber 24.

When modern slugs are used as a projectile as illustrated in FIG. 1, as opposed to case or swaged balls, there may be no need to grease the chambers 24 to prevent chain fire. This is for a couple of reasons. First, the likelihood that modern smokeless gunpowder will be ignited by flashback from the ignition of another chamber is highly unlikely due to the very stable nature of modern smokeless gunpowder. Second, the projectile portion 26 of chamber 24 is sized with an inner diameter that closely matches or is slightly smaller than the outer diameter of the projectile for which it is designed. In this way, a tight fit between the projectile and the inner diameter of the chamber 24 will tend to prevent any flashback from reaching the modern smokeless gunpowder 36. Further, if the projectile used is a modern slug, these slugs typically include grooves 60 around the outer periphery of the body portion of the slug that is filled with a lubrication material. This lubrication material also provides a barrier against flashback from another chamber to further minimize the risk of any chain fire event.

Once the proper measure of modern smokeless gunpowder and the projectile have been muzzle-loaded into the main cylinder body 12, the body 12 is then inverted so that the breech end 16 is then upward. The loading plate 56 is then removed from the breech end of the main cylinder body 12. The primers are then installed in the primer portion 30 of the chambers 24. The cylinder cap 14 is then placed on the main cylinder body 12 to form the cylinder assembly 10, which is then reinstalled into the muzzle-loading revolver.

Such a muzzle-loading revolver 62 is illustrated with the cylinder assembly 10 of the present invention installed therein in place of the original black powder cylinder supplied with the revolver 62. This muzzle-loading revolver includes a barrel 64, a frame 66, hammer 68, trigger 70, and grip 72. The percussion plate 74 is formed at the breech end of the frame 66 adjacent to the cylinder assembly 10.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A smokeless cylinder for a muzzle-loading revolver, the cylinder adapted to allow the use of smokeless gun powder to fire the revolver, comprising:

a cylinder body having a muzzle end and a breach end, the cylinder body defining therein a number of chambers, each chamber including a projectile portion opening at the muzzle end and having a first diameter sized to accommodate a particular caliber projectile, a propellant portion having a second diameter smaller than the first diameter, and a primer portion opening at the breach end and having a third diameter larger than the second diameter sized to accommodate a primer; and primer portion and the propellant portion are axially aligned; and a cylinder cap having captured therein the number of linearly translatable firing pins, the cylinder cap being removably positioned on the breach end of the cylinder body.

2. The smokeless cylinder of claim 1, wherein each chamber includes a shoulder between the projectile portion and the propellant portion.

3. The smokeless cylinder of claim 2, wherein the shoulder forms a conical surface transition between the larger first diameter of the projectile portion and the smaller second diameter portion of the propellant portion.

4. The smokeless cylinder of claim 1, wherein the cylinder cap is held in rotational position relative to the cylinder body by a locating pin.

5. The smokeless cylinder of claim 1, wherein each firing pin is positioned within the cylinder cap by a fairel.

6. The smokeless cylinder of claim 1, wherein the cylinder cap includes a plurality of ratchets in a breach end thereof.

7. The smokeless cylinder of claim 1, wherein the cylinder cap is axially translatable relative to the cylinder body when positioned thereon.

8. The smokeless cylinder of claim 1, wherein the projectile portion and the primer portion of each chamber are axially offset from one another.

9. The smokeless cylinder of claim 1, further comprising a loading plate adapted to cover the primer portion openings on the breach end of the cylinder body upon removal of the cylinder cap to facilitate muzzle loading of the cylinder body.

10. A muzzle-loading revolver, comprising:

a frame;

a barrel;

a trigger;

a hammer; and a cylinder having a cylinder body having a muzzle end and a breach end, the cylinder body defining therein a number of chambers, each chamber including a projectile portion opening at the muzzle end and having a first diameter sized to accommodate a particular caliber projectile, a propellant portion having a second diameter smaller than the first diameter, and a primer portion opening at the breach end and having a third diameter larger than the second diameter sized to accommodate a primer, and primer portion and the propellant portion are axially aligned, and a cylinder cap having captured therein the number of linearly translatable firing pins, the cylinder cap being removably positioned on the breach end of the cylinder body.

11. A muzzle-loading revolver, comprising:

a frame;

a barrel;

a trigger;

a hammer;

a cylinder having a cylinder body having a muzzle end and a breach end, the cylinder body defining therein a number of chambers, each chamber including a projectile portion opening at the muzzle end and having a first diameter sized to accommodate a particular caliber projectile, a propellant portion having a second diameter smaller than the first diameter, and a primer portion opening at the breach end and having a third diameter larger than the second diameter sized to accommodate a primer, and a cylinder cap having captured therein the number of linearly translatable firing pins, the cylinder cap being removably positioned on the breach end of the cylinder body;

wherein the cylinder cap is axially translatable relative to the cylinder body within the frame between contact with the cylinder body and a percussion plate of the frame; and wherein the axial translation of the cylinder cap is between 0.002 and 0.006 inch.

12. A muzzle-loading revolver, comprising:

a frame;

a barrel;

a trigger;

a hammer;

a cylinder having a cylinder body having a muzzle end and a breach end, the cylinder body defining therein a number of chambers, each chamber including a projectile portion opening at the muzzle end and having a first diameter sized to accommodate a particular caliber projectile, a propellant portion having a second diameter smaller than the first diameter, and a primer portion opening at the breach end and having a third diameter larger than the second diameter sized to accommodate a primer, and a cylinder cap having captured therein the number of linearly translatable firing pins, the cylinder cap being removably positioned on the breach end of the cylinder body; and a loading plate adapted to cover the primer portion openings on the breach end of the cylinder body upon removal of the cylinder from the frame and the cylinder cap from the cylinder body to facilitate muzzle loading of the cylinder body.

13. The muzzle-loading revolver of claim 12, wherein each chamber includes a shoulder between the projectile portion and the propellant portion, the shoulder forming a conical surface transition between the larger first diameter of the projectile portion and the smaller second diameter portion of the propellant portion.

14. The muzzle-loading revolver of claim 12, wherein each firing pin is radially positioned within the cylinder cap to axially align with the hammer.

15. The muzzle-loading revolver of claim 12, wherein the cylinder cap is axially translatable relative to the cylinder body within the frame between contact with the cylinder body and a percussion plate of the frame.

16. The muzzle-loading revolver of claim 12, wherein the projectile portion and the primer portion of each chamber are axially offset from one another to allow the firing pin to align with the hammer and the projectile portion to align with the barrel.

17. The muzzle-loading revolver of claim 16, wherein the primer portion and the propellant portion are axially aligned.

18. A method of muzzle loading a smokeless cylinder for use in a muzzle-loaded revolver, the cylinder including a cylinder body having a number of chambers therein and a cylinder cap having the number of firing pins positioned therein, comprising the steps of:

removing the cylinder cap from a breach end of the cylinder body;

placing a loading plate over the breach end of the cylinder body;

orienting the cylinder body and loading plate assembly vertically such that a muzzle end of the cylinder body is above the breach end;

pouring a pre-measured amount of smokeless gun powder into at least one of the chambers;

placing a projectile into the at least one of the chambers;

re-orienting the cylinder body and loading plate assembly vertically such that the breach end of the cylinder body is above the muzzle end;

removing the loading plate;

inserting a primer into the at least one of the chambers; and re-installing the cylinder cap on the breach end of the cylinder body.

19. The method of claim 18, wherein the step of placing a projectile into the at least one of the chambers comprises the step of pressing the projectile into the at least one of the chambers until a shoulder within the chamber is contacted.

* * * * *